US010168656B2

(12) United States Patent
Meguro

(10) Patent No.: US 10,168,656 B2
(45) Date of Patent: Jan. 1, 2019

(54) IMAGE FORMING APPARATUS WITH CLEANING BLADE ANGLE DETECTOR AND ANGLE CHANGER

(71) Applicant: KONICA MINOLTA, INC., Tokyo (JP)

(72) Inventor: Taichi Meguro, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/863,190

(22) Filed: Jan. 5, 2018

(65) Prior Publication Data

US 2018/0203405 A1 Jul. 19, 2018

(30) Foreign Application Priority Data

Jan. 19, 2017 (JP) ..... 2017-007232

(51) Int. Cl.
*G03G 21/00* (2006.01)
*G03G 15/00* (2006.01)
*G03G 15/16* (2006.01)

(52) U.S. Cl.
CPC ..... *G03G 21/0011* (2013.01); *G03G 15/161* (2013.01); *G03G 15/50* (2013.01); *G03G 2215/1661* (2013.01)

(58) Field of Classification Search
CPC ..... G03G 15/161; G03G 21/0011; G03G 21/0029; G03G 2215/1647; G03G 2215/1661; G03G 2221/0089
USPC ..... 399/34, 71, 101, 350
See application file for complete search history.

(56) References Cited

U.S. PATENT DOCUMENTS 7,929,878 B1 * 4/2011 Thayer ..... G03G 21/0029 399/71
7,941,067 B2 * 5/2011 Thayer ..... G03G 21/0017 399/123
8,774,697 B2 * 7/2014 Dobbertin ..... G03G 21/0029 399/351
2010/0272460 A1 * 10/2010 Zona ..... G03G 15/55 399/71
2017/0248873 A1 * 8/2017 Maeyama ..... G03G 15/161

FOREIGN PATENT DOCUMENTS

JP 08129327 A * 5/1996
JP 2007108334 A * 4/2007
JP 2014134620 A 7/2014
JP 2015072397 A * 4/2015

* cited by examiner

*Primary Examiner* — Robert Beatty
(74) *Attorney, Agent, or Firm* — Lucas & Mercanti, LLP

(57) ABSTRACT

An image forming apparatus forms an image by transferring a toner image to a sheet, the toner image being formed on an image carrier belt with an elastic layer on a surface. The apparatus includes a rigid blade, an angle detector, an angle changer and a hardware processor. The rigid blade contacts with the image carrier from which the toner image has been transferred to the sheet, so as to clean residue attached on the surface of the image carrier. The angle detector detects an effective contact angle between the surface of the image carrier and an opposed surface of the rigid blade opposed to the image carrier. The angle changer changes the effective contact angle. The hardware processor controls the angle changer according to a detection result by the angle detector to regulate the effective contact angle to a predetermined range.

14 Claims, 7 Drawing Sheets

| | | WITHOUT CONTROL | EVERY 30 SHEETS | EVERY 10 SHEETS | ALWAYS |
|---|---|---|---|---|---|
| PRINTABLE NUMBER OF SHEETS | 50 | ○ | ○ | ○ | ○ |
| | 100 | ○ | ○ | ○ | ○ |
| | 200 | ○ | ○ | ○ | ○ |
| | 300 | × | ○ | ○ | ○ |
| | 400 | × | × | ○ | ○ |
| | 500 | × | × | ○ | ○ |
| | 600 | × | × | × | ○ |

IMAGE FORMING APPARATUS WITH CLEANING BLADE ANGLE DETECTOR AND ANGLE CHANGER

BACKGROUND

1. Technological Field

The present invention relates to an image forming apparatus.

2. Description of the Related Art

Image forming apparatuses that have been widely used form a toner image on a photoreceptor, transfer the toner image onto an intermediate transfer belt (image carrier) and further transfer the toner image from the intermediate transfer belt onto a sheet.

For such image forming apparatuses, a configuration called blade cleaning has been known in the art to remove residual toner on the intermediate transfer belt after image transfer to a sheet, in which a blade that contacts with the intermediate transfer belt to scrape off the residual toner is disposed in the downstream in the moving direction of the intermediate transfer belt with respect to the site of the transfer to a sheet (e.g. see JP 2014-134620A).

Commonly-used intermediate transfer belts are typically made of a resin material. However, since there is a difference in microscopic surface unevenness among paper types to be used (e.g. plain paper, thin coated paper, board paper and the like), it is sometimes difficult to maintain the transfer property due to the decreased contact between the intermediate transfer belt and a sheet in the transfer site. In order to prevent such deterioration of the transfer property, an intermediate transfer belt including a based layer of a resin material and an elastic layer of a rubber material or the like on the base layer has been proposed.

On the other hand, an elastic blade is typically used in the above-described blade cleaning. When the blade cleaning is applied to such an intermediate transfer belt with an elastic layer, the intermediate transfer belt requires very high driving torque since the elastic blade contacts with the elastic layer thereof. This may sometimes result in a turn-up of the blade.

To cope with the problem, it has been considered to use a blade of a metal thin plate (rigid blade) to reduce the belt driving torque.

However, this configuration is a combination of a rigid blade, which is likely to let particles (paper dust) with a diameter less than toner particles escape through the edge, and an intermediate transfer belt, which is likely to cause micro deformation of the elastic layer that lets such paper dust escape through the blade and that readily incorporates such escaped paper dust.

This configuration is likely to cause a phenomenon called paper dust filming, in which paper dust K that has escaped through the edge 61 of a rigid blade is buried in the surface (elastic layer) 62 of an intermediate transfer belt to change the belt gross as illustrated in FIG. 12.

The paper dust filming tends to be developed at an accelerated pace, for example, when the edge 61 of the rigid blade is worn away to form a minute separation of the edge 61 that increases the amount of escaping paper dust K as illustrated in FIG. 13.

Once the paper dust filming occurs, it may become impossible to optically detect the amount of toner attached on the intermediate transfer belt correctly.

SUMMARY

The present invention has been made in view of the above-described problem, and an object thereof is to provide an image forming apparatus that can prevent such a minute edge separation and thereby prevent the occurrence of paper dust filming.

To achieve at least one of the abovementioned objects, according to an aspect of the present invention, an image forming apparatus forms an image by transferring a toner image to a sheet, the toner image being formed on an image carrier belt with an elastic layer on a surface. The apparatus includes:

a rigid blade which contacts with the image carrier from which the toner image has been transferred to the sheet, so as to clean residue attached on the surface of the image carrier;

an angle detector which detects an effective contact angle between the surface of the image carrier and an opposed surface of the rigid blade opposed to the image carrier;

an angle changer which changes the effective contact angle; and a hardware processor which controls the angle changer according to a detection result by the angle detector to regulate the effective contact angle to a predetermined range.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

First, the configuration of an image forming apparatus according to the embodiment will be described.

Figure 1:
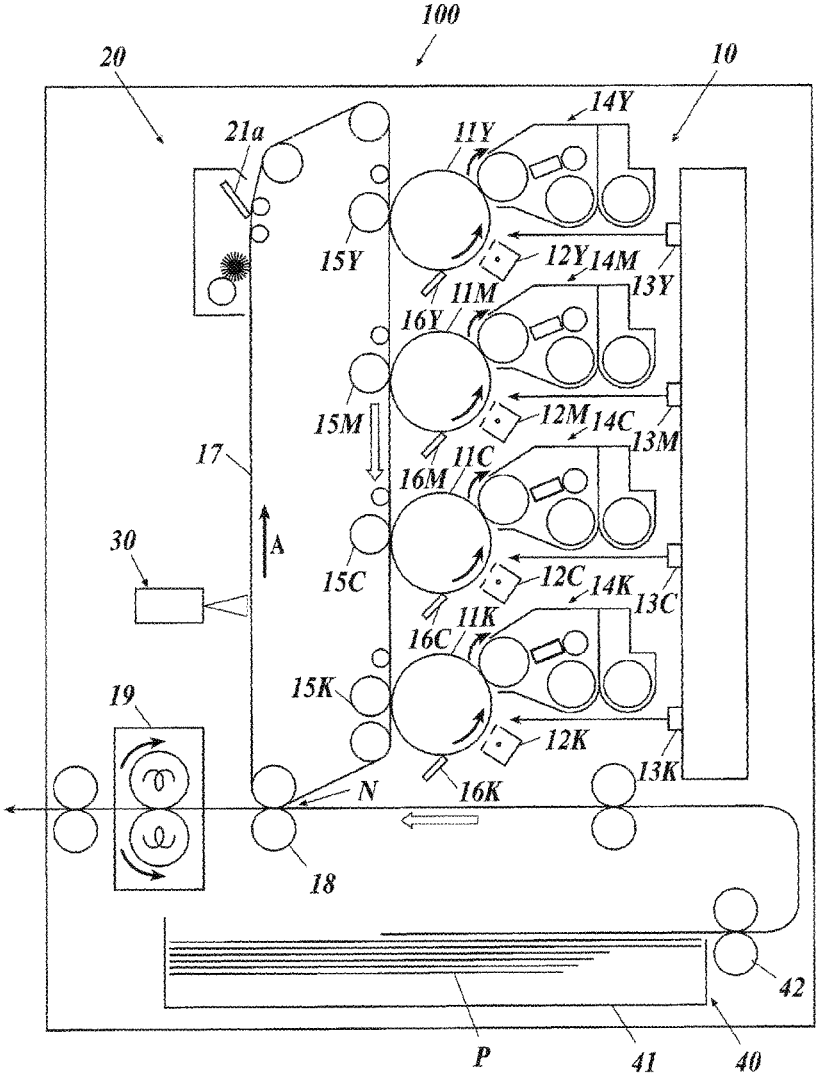
FIG. 1 is a schematic configuration view of an image forming apparatus according to an embodiment of the present invention.
Figure 2:
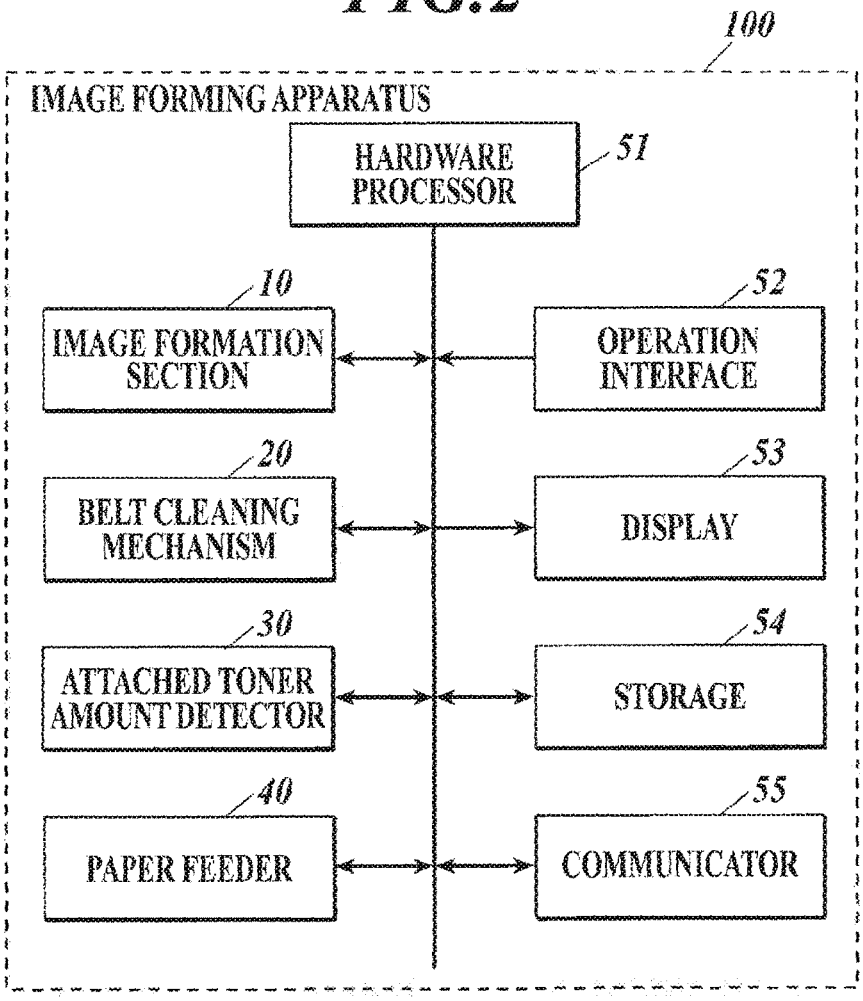
FIG. 2 is a functional block diagram of the operational configuration of the image forming apparatus.

FIG. 1 is a schematic configuration view of the image forming apparatus 100. FIG. 2 is a block diagram of the functional configuration of the image forming apparatus 100.

As illustrated in FIG. 1 and FIG. 2, the image forming apparatus 100 includes an image formation section 10, a belt cleaning mechanism 20, an attached toner amount detector 30, a sheet feeder 40, a hardware processor 51, an operation interface 52, a display 53, a storage 54, a communicator 55 and the like, which are connected to each other via a bus.

The image formation section 10 includes photoreceptor drums 11Y, 11M, 11C, 11K that correspond respectively to colors of yellow (Y) magenta (M), cyan (C) and black (K), chargers 12Y, 12M, 12C, 12K, exposers 13Y, 13M, 13C, 13K, developers 14Y, 14M, 14C, 14K, primary transfer rollers 15Y, 15M, 15C, 15K, photoreceptor cleaners 16Y, 16M, 16C, 16K, an intermediate transfer belt 17 as an image carrier, a secondary transfer roller 18 and a fixation section 19.

The chargers 12Y, 12M, 12C, 12K uniformly charge photoreceptor drums 11Y, 11M, 11C, 11K.

The exposers 13Y, 13M, 13C, 13K are constituted by respective laser light sources, polygon mirrors, lenses and the like. The exposers 13Y, 13M, 13C, 13K scan the surfaces of the photoreceptor drums 11Y, 11M, 11C, 11K with laser beams to expose them based on image data of the respective colors so as to form electrostatic latent images.

The developers 14Y, 14M, 14C, 14K attach respective color toners to the electrostatic latent images on the photoreceptor drums 11Y, 11M, 11C, 11K to develop them.

The primary transfer rollers 15Y, 15M, 15C, 15K sequentially transfer the toner images of the respective colors formed on the photoreceptor drums 11Y, 11M, 11C, 11K onto the intermediate transfer belt 17 (primary transfer). That is, the toner images of the four colors are overlaid to form a color toner image on the intermediate transfer belt 17.

The photoreceptor cleaners 16Y, 16M, 16C, 16K remove residual toner that is left on the circumferential surfaces of the photoreceptor drums 11Y, 11M, 11C, 11K after the transfer.

The intermediate transfer belt 17 is an endless belt with an elastic layer, which is supported by rollers and driven around in the direction indicated by the arrow A in FIG. 1. The detailed configuration of the intermediate transfer belt 17 will be described later.

The secondary transfer roller 18 transfers the color toner image formed on the intermediate transfer belt 17 onto either surface of a sheet P fed from the sheet feeder 40 at once (secondary transfer).

The fixation section 19 heats and presses the toner transferred on the sheet P to fix it to the sheet P.

The belt cleaning mechanism 20 is provided to clean the intermediate transfer belt 17 by bringing the edge of a rigid blade 21*a* into contact with the intermediate transfer belt 17 from which the color toner image has been transferred to the sheet P by means of the secondary transfer roller 18 so as to remove residues on the intermediate transfer belt 17 such as untransferred residual toner and paper dust. The detailed configuration of the belt cleaning mechanism 20 will be described later.

The attached toner amount detector 30 is constituted by an optical sensor and the like that is opposed to the surface (for forming the color toner image) of the intermediate transfer belt 17.

For example, the attached toner amount detector 30 detects a toner patch that is formed on the surface of the intermediate transfer belt 17 to detect the image density and the color registration. Based on the detection value of the toner patch, the image formation section 10 corrects the image density and the color registration.

The sheet feeder 40 is disposed in the lower part of the image forming apparatus 100. The sheet feeder 40 includes a detachable sheet feeding cassette 41. The sheets P stored in the sheet feeding cassette 41 are fed to a conveyance path one by one from the top by means of a sheet feeding roller 42.

The hardware processor 51 is constituted by a CPU (central processing unit), a ROM (read only memory), a RAM (random access memory) and the like. The hardware processor 51 integrally controls the operation of the components of the image forming apparatus 100. The CPU reads out a variety of programs stored in the ROM, develops them on the RAM and performs a variety of processing according to the developed programs.

The operation interface 52 is constituted by a touch panel formed over the display screen of the display 53 and a variety of operation buttons such as number buttons and a start button. The operation interface 52 outputs an operation signal to the hardware processor 51 according to a user operation.

The display 53 is constituted by an LCD (liquid crystal display). The display 53 displays a variety of screens according to a display signal input from the hardware processor 51.

The storage 54 is constituted by a storage device such as a non-volatile semiconductor memory and a hard disk. The storage 54 stores data and the like relating to the variety of processing.

The communicator 55 sends and receives data to and from an external apparatus connected to a network such as a LAN (local area network).

Configuration of Intermediate Transfer Belt

Next, the configuration of the intermediate transfer belt 17 will be described.

Figure 3:
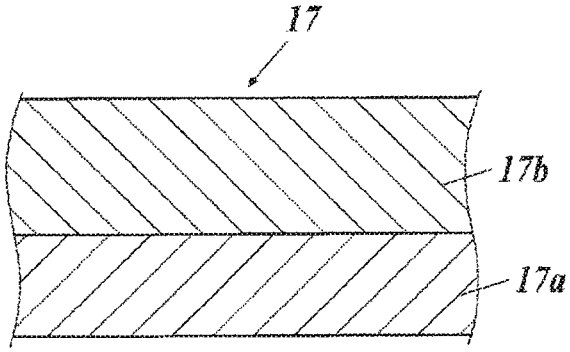
FIG. 3 is a cross-sectional view of an intermediate transfer belt.

FIG. 3 is a cross-sectional view of the intermediate transfer belt 17.

For example, the intermediate transfer belt 17 may be constituted by an elastic belt that includes a base layer 17*a* and an elastic layer 17*b* of a rubber such as acrylonitrile-butadiene rubber (NBR) or chloroprene rubber (CR) formed on the base layer 17*a* as illustrated in FIG. 3.

To improve the conveyance property of the intermediate transfer belt 17, it is preferred that the thickness of the base layer 17*a* ranges approximately from 50 μm to 100 μm. To improve the transfer property to an uneven sheet P, it is preferred that the thickness of the elastic layer 17*b* ranges approximately from 100 μm to 500 μm.

To reduce the tackiness, an oxidized layer with a thickness of approximately from 5 μm to 20 μm or a coating layer with a thickness of approximately from 30 μm to 50 μm may be provided on the surface of the elastic layer 17*b*.

However, the material and thickness of the intermediate transfer belt 17 are not limited to these compounds and ranges, and the intermediate transfer belt may be constituted by any belt that has desired transfer property.

It is preferred that the intermediate transfer belt 17 has a surface microhardness of from 50 MPa to 500 MPa or more. The surface microhardness is evaluated with a microhardness tester (FISCHERSCOPE H100) with a 90° indenter (Cube Corner Top) at a maximum load of 30 μN.

When the surface microhardness of the intermediate transfer belt 17 is less than 50 MPa, i.e. the elastic layer 17*b* is too soft, a micro deformation is caused in the surface of the elastic layer 17*b* to produce a reaction force on the edge of the rigid blade 21*a* in the escaping direction. This may cause an escape of residual toner and resultant imperfect cleaning.

When the surface microhardness of the intermediate transfer belt 17 is greater than 500 MPa, i.e. the elastic layer 17*b* is too hard, no micro deformation is caused in the surface of the elastic layer 17*b*, and the surface of the elastic layer 17*b* cannot follow the unevenly contacting edge of the rigid blade 21*a*. This may form a minute gap that causes an escape of residual toner and resultant imperfect cleaning.

Configuration of Belt Cleaning Mechanism

Next, the configuration of the belt cleaning mechanism 20 will be described.

Figure 4:
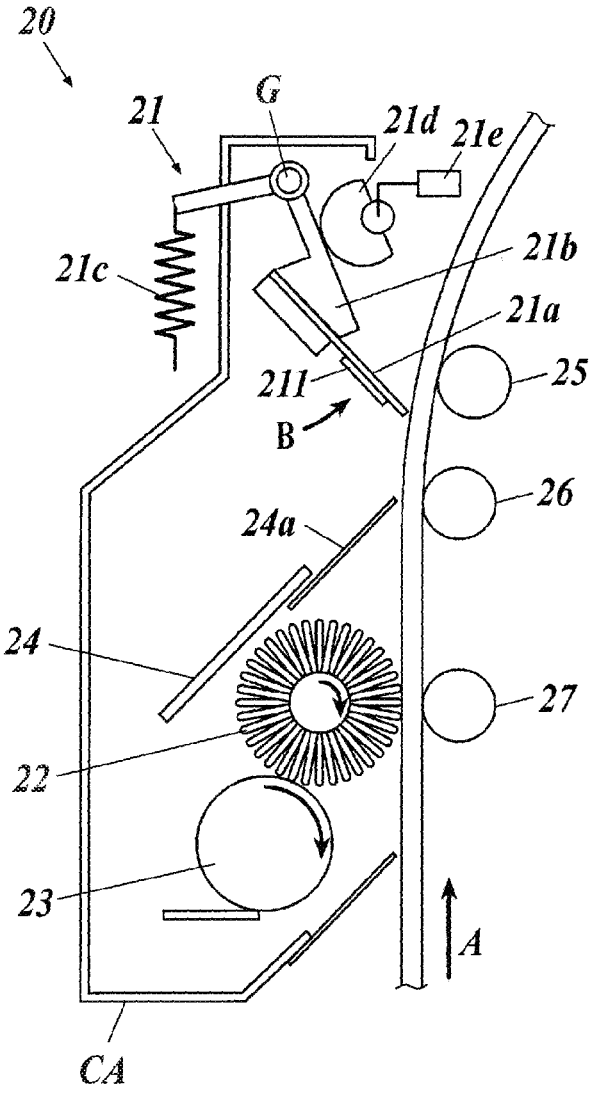
FIG. 4 is a schematic configuration view of a belt cleaning mechanism.
Figure 5:
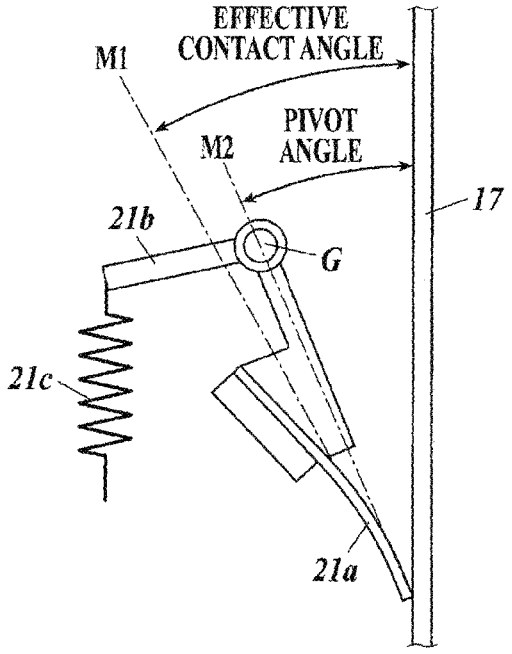
FIG. 5 illustrates the configuration of a rigid blade.

FIG. 4 is a schematic configuration view of the belt cleaning mechanism 20. FIG. 5 illustrates the angle of the rigid blade 21*a* with respect to the intermediate transfer belt 17. A cam 21*d* and strain gauges 211 are not shown in FIG. 5.

The components of the belt cleaning mechanism 20 are long in the width direction transverse to the moving direction of the intermediate transfer belt 17.

For example, the belt cleaning mechanism 20 includes: a casing CA; a blade section 21 disposed in the casing CA; a pre-brush 22 and a flicker roller 23 disposed below the blade section 21 in the casing CA; and a partition wall 24 disposed between the blade section 21 and the pre-brush 22 as illustrated in FIG. 4.

The belt cleaning mechanism further include a blade counter roller 25, an antivibration roller 26 and a brush counter roller 27, which are opposed to the casing CA across the intermediate transfer belt 17.

For example, the blade section 21 includes the rigid blade 21*a*, a blade holder 21*b*, a biasing spring 21*c* and the cam 21*d*.

The rigid blade 21*a* is configured such that the edge thereof contacts with the running intermediate transfer belt 17 to scrape and remove residues on the intermediate transfer belt 17. The rigid blade 21*a* is rotatably held about a pivot G by the blade holder 21*b*.

The blade holder 21*b*, which holds the rigid blade 21*a* at one end, is rotatable about the pivot G. The blade holder 21*b* is engaged with the biasing spring 21*c* at the other end, and the biasing spring provides a contacting force (contact pressure) of the rigid blade 21*a* against the intermediate transfer belt 17.

For example, the biasing spring 21*c* is constituted by a coil tension spring. The biasing spring 21*c* provides a rotary force to the blade holder 21*b* and the rigid blade 21*a* in the anticlockwise direction so that the rigid blade 21*a* is in pressure contact with the intermediate transfer belt 17 at a constant pressure.

This constant pressure contact (spring-loaded contact) allows maintaining the contact pressure at a proper level regardless of the environment. Instead of a coil tension spring, any other means such as a coil compression spring that can create constant pressure contact may be used.

When the rigid blade 21*a* contacts with the intermediate transfer belt 17 with this configuration, the thin rigid blade 21*a* is sometimes bent, and the contact angle between the rigid blade 21*a* and the intermediate transfer belt 17 is changed accordingly.

As illustrated in FIG. 5, the angle between the surface of the intermediate transfer belt 17 and the opposed surface of the rigid blade 21*a* opposed to the intermediate transfer belt 17 is referred to as an "effective contact angle".

The "effective contact angle" is the angle between the intermediate transfer belt 17 and the rigid blade 21*a*, i.e. between the tangent M1 of the opposed surface of the rigid blade 21*a* and the surface of the intermediate transfer belt 17, when the intermediate transfer belt 17 is in contact with the rigid blade 21*a* so that the rigid blade 21*a* is bent.

Further, the angle between the virtual line M2 connecting the pivot G of the rigid blade 21*a* and the contact point between the rigid blade 21*a* and the intermediate transfer belt 17, and the surface of the intermediate transfer belt 17 is referred to as a "pivot angle".

In the embodiment, the default setting is selected so that the remainder of the effective contact angle subtracted by the pivot angle ranges from 0° to less than 2° as illustrated in FIG. 5.

When the remainder of the effective contact angle subtracted by the pivot angle is less than 2°, it can be easy to reduce the occurrence of edge separation of the rigid blade 21*a*. When the remainder of the effective contact angle subtracted by the pivot angle is not less than 0°, the intermediate transfer belt 17 can be prevented from being shaved, which is caused by draw-in of the edge of the rigid blade 21*a* and the resultant increase of the contact pressure.

The cam 21*d* is rotary driven by a driver 21*e*.

The cam 21*d*, which is in contact with the blade holder 21*b*, is rotary driven by the driver 21*e* according to a control of the hardware processor 51 so as to change the installation angle (effective contact angle) of the blade holder 21*b* and the rigid blade 21*a* with respect to the intermediate transfer belt 17.

The cam 21*d* serves as an angle changer.

The configuration of the rigid blade 21*a* will be described in more detail.

Figure 6:
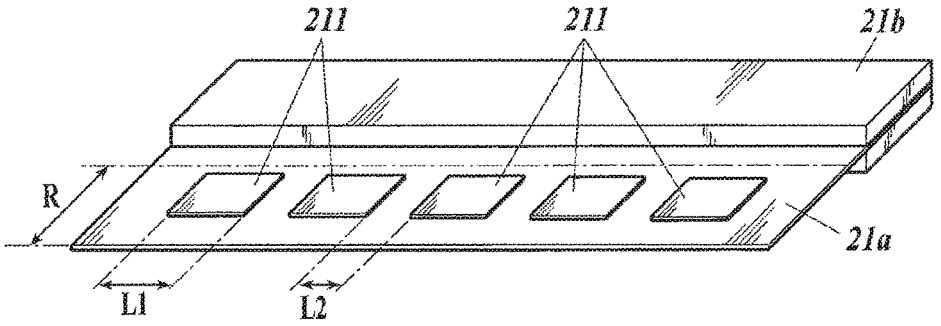
FIG. 6 illustrates the angle of the rigid blade with respect to the intermediate transfer belt.

FIG. 6 is a view of the rigid blade 21*a* from the direction of the arrow B in FIG. 4.

As illustrated in FIG. 6, the rigid blade 21*a* is a cleaning blade that is constituted by a metal thin plate. For example, the material may be stainless steel (SUS) in terms of the hardness, the processability and the cost.

It has been known that the rigid blade 21*a* is worn away with use by the external additives of toner such as silica. To improve the abrasion resistance while reducing the occurrence of edge separation, the surface may be plated (e.g. hard chromium plating, DLC plating or the like). A harder metal coating layer may be formed on the surface of the metal plate rigid blade 21*a*.

It is preferred that the coating layer of the rigid blade 21*a* has a thickness of from 1 μm to 10 μm and a Vickers hardness of 1000 HV or more. The coating layer with a Vickers hardness of 1000 HV or more, which is equal to or higher than that of additive silica of the toner, allows a long-term use of the rigid blade 21 until the wear limit of edge separation.

For example, the thickness of the rigid blade 21*a* may range from 0.07 mm to 0.20 mm.

When the thickness of the rigid blade 21*a* is less than 0.07 mm, the degree of deflection of the rigid blade 21*a*, which corresponds to the fluctuating torque between the intermediate transfer belt 17 and the rigid blade 21*a*, become too large, which may increase the occurrence of edge separation.

When the thickness of the rigid blade 21*a* is greater than 0.20 mm, the rigid blade 21*a* cannot have sufficiently tracing property in the edge direction, which may increase the escape due to the micro unevenness of the intermediate transfer belt 17.

That is, the rigid blade 21*a* with a thickness within the above-described range can reduce the occurrence of edge separation and micro escape.

On the surface of the rigid blade 21*a*, strain gauges (measurement section) 211 are provided. The strain gauges 211 together with the hardware processor 51 serve as an angle detector.

A "strain gauge", which is constituted by a micron-level metal foil photo-etched on a resin material, is a sensor for detecting a strain based on a change of the resistance of the metal foil according to an expansion or contraction.

That is, the embodiment is configured to be able to measure the deflection of the rigid blade 21*a* with the strain gauges 211 when the rigid blade 21*a* is bent.

It is preferred that the strain gauges 211 are disposed on the other surface (under surface in FIG. 4) of the rigid blade 21*a* from the surface opposed to the intermediate transfer belt 17. This is because if the strain gauges 211 came off, the detached strain gauges 211 would not contact with the intermediate transfer belt 17 to damage it.

The length (L1) of each of the strain gauges 211 in the longitudinal direction of the rigid blade 21*a* (the length of the detection areas of the effective contact angle) is preferably equal to or greater than 2 mm.

Since the rigid blade 21 has high rigidity, a local micro deformation, for example, caused by a foreign object on the intermediate transfer belt 17, may affect the effective contact angle. However, when the detection areas of the effective contact angle are equal to or greater than 2 mm in the longitudinal direction of the rigid blade 21*a*, each of the detection areas is longer than the length in the longitudinal direction of an area that follows such local deformation. This can eliminate the influence of such local deformation.

It is preferred that the strain gauges 211 are disposed in the region R with a length of 12 mm or less in the transverse direction of the rigid blade 21*a* from the distal end of the rigid blade 21*a*, i.e. the edge of the rigid blade 21*a*.

This is because the effective contact angle cannot be accurately measured in the area over 12 mm from the edge of the rigid blade 21*a* in the transverse direction of the rigid blade 21*a*.

It is preferred that the spacing (L2) between the strain gauges 211 (spacing between the detection areas) ranges from 10 mm to 100 mm.

When the spacing between the detection area is less than 10 mm, there is no significant difference between the measurement results of adjacent detection areas since the rigid blade 21*a* has high rigidity. That is, such short spacing results in only the increased number of measurement points and the increase cost. When the spacing between the detection areas is greater than 100 mm, it is difficult to accurately detect the distribution of the effective contact angle in the longitudinal direction of the rigid blade 21*a*.

The thickness of the strain gauges 211 is preferably equal to or less than a half of the thickness of the rigid blade 21*a*. This is because when the strain gauges 211 are thicker than a half of the thickness of the rigid blade 21*a*, they affects the effective contact angle.

Back to FIG. 4, the pre-brush 22 is disposed in the casing CA below the rigid blade 21*a* in the upstream in the moving direction of the intermediate transfer belt 17 with respect to the rigid blade 21*a*.

The pre-brush 22 rotates in the counter direction to the moving direction of the intermediate transfer belt 17. The pre-brush 22 removes paper dust on the intermediate transfer belt 17 that is to enter the rigid blade 21*a*, so as to reduce the occurrence of paper dust filming in the rigid blade 21*a*.

Between the pre-brush 22 and the intermediate transfer belt 17, for example, a torque of 0.10 N·m or more is provided.

The material, properties and configuration of the pre-brush 22 are not particularly limited, and the pre-brush 22 may be constituted by any brush that has a predetermined paper dust removing function.

Instead of a brush, i.e. the pre-brush 22, a roller may be provided.

The flicker roller 23 is disposed below the pre-brush 22 in a position contactable with the pre-brush 22.

The flicker roller 23 rotates in the counter direction to the rotation direction of the pre-brush 22 to remove the paper dust attached on the pre-brush 22.

The material, properties and configuration of the flicker roller 23 are not particularly limited, and the flicker roller 23 may be constituted by any roller that has a predetermined flicking function.

On the flicker roller 23, a scraper 23*a* is provided to scrape off the paper dust on the flicker roller 23.

The partition wall 24 is disposed between the rigid blade 21*a* and the pre-brush 22 such that one end away from the intermediate transfer belt 17 is lower than the other end close to the intermediate transfer belt 17. A urethane sheet 24*a* is disposed at the end close to the intermediate transfer belt 17 of the partition wall 24.

The partition wall 24 is provided to catch residues that are scraped off from the rigid blade 21*a* and falls by its own weight and to convey them to a conveyance screw (not shown). The partition wall 24 thus prevents the scraped residues from reattaching to the intermediate transfer belt 17 and entering the rigid blade 21*a* again. Further, the urethane sheet 24*a* can reduce the sliding frictional load on the intermediate transfer belt 17.

The residues conveyed by the conveyance screw are discharged to the outside of the casing CA by means of the same conveyance screw.

The blade counter roller 25 is opposed to the rigid blade 21*a* across the intermediate transfer belt 17.

It is preferred that the blade counter roller 25 is slightly deviated by approximately 1 mm from the edge of the rigid blade 21*a* to the downstream in the moving direction of the intermediate transfer belt 17.

In this position, the blade counter roller 25 can reduce the occurrence of so-called staple-shaped escape, in which a micro bump on the blade counter roller 25 or the intermediate transfer belt 17 lifts the rigid blade 21*a* to cause an escape at the both sides of the micro bump.

It is preferred that the antivibration roller 26 is disposed in the upstream of the blade counter roller 25, specifically in the area with a length of approximately from 1 mm to 40 mm in the upstream in the moving direction of the intermediate transfer belt 17 from the edge of the rigid blade 21*a*.

The antivibration roller 26 is provided to reduce the vibration of the intermediate transfer belt 17.

When the blade counter roller 25 is disposed in the deviated position from the edge of the rigid blade 21*a* as described above, it may sometimes be difficult to measure the effective contact angle of the rigid blade 21*a* with high accuracy since the angle readily changes due to the vibration of the intermediate transfer belt 17. The antivibration roller 26 can reduce such belt vibration.

Further, when the antivibration roller 26 is a driven roller that is in pressure contact with the intermediate transfer belt 17 in a fixed position, it can completely prevent the vibration of the belt.

The brush counter roller 27 is opposed to the pre-brush 22 across the intermediate transfer belt 17. The brush counter roller 27 maintains the paper dust removing function of the pre-brush 22 at a good level.

Next, the operation of the belt cleaning mechanism 20 of the embodiment will be described.

The belt cleaning mechanism 20 of the embodiment performs a cleaning operation to scrape and remove the residues on the intermediate transfer belt 17 that has not transferred to a sheet P by means of the rigid blade 21*a* of the blade section 21.

Unlike a rubber blade, the rigid blade 21*a* does not deform to trace the intermediate transfer belt 17. For example, when the rigid blade 21*a* is worn out, even a minute change of the contact angle may slightly lift up the edge. To prevent edge separation of the rigid blade 21*a* from beginning to end of the use, it is preferred to maintain the effective contact angle at a predetermined angle.

In the embodiment, the effective contact angle of the rigid blade 21*a* is constantly detected during image formation, and the contact condition (effective contact angle) of the rigid blade 21*a* is adjusted based on the detection result.

Figure 7:
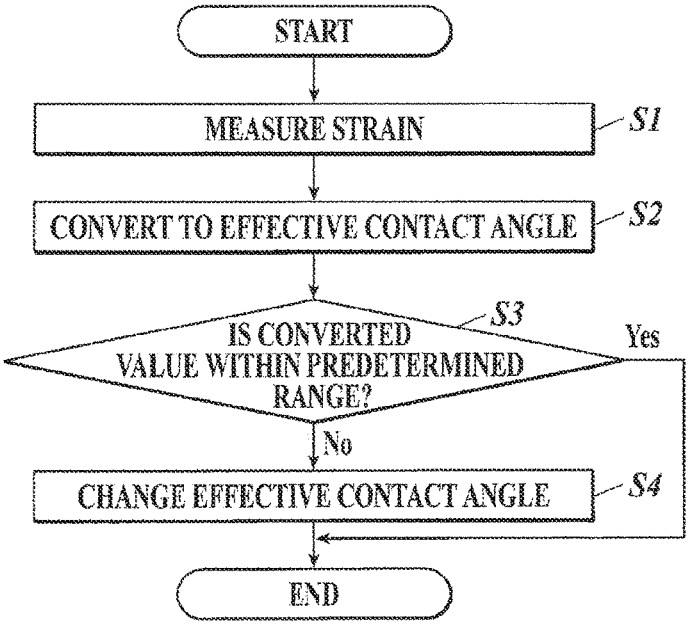
FIG. 7 is a flowchart of effective contact angle adjustment processing.

FIG. 7 is a flowchart of the control of this effective contact angle adjustment processing.

First, the hardware processor 51 measures the strain with the strain gauges 211 disposed on the rigid blade 21*a*, and calculates the average thereof (Step S1).

When the rigid blade 21*a* is bent to expand or contract the strain gauges 211, the strain is detected from a change of the resistance of the metal foils of the strain gauges 211. The measurement values of strain detected by the strain gauges 211 correspond to the degree of deflection of the rigid blade 21*a*.

The hardware processor 51 thus calculates the average of the measurement values detected by the strain gauges 211.

Then, the hardware processor 51 serves as a calculator to convert the average calculated in Step S1 to the effective contact angle using the following Expression 1 (Step S2).

$$\text{Change of Effective Contact Angle } (\Delta\alpha) = 0.36 \times \text{Actual Measurement Value} \quad (1)$$

The conversion formula of Expression 1 is prestored in the storage 54. Instead of the conversion formula, any means such as a conversion table that can convert the measurement values to the effective contact angle may be used.

Then, the hardware processor 51 makes a determination as to whether the converted value calculated in Step S2 falls within a predetermined range (Step S3). When the converted value falls within the predetermined range (Step S3, Yes), the processing ends.

The predetermined range is a preset acceptable range including an ideal value (target value) for the calculated converted value.

When the converted value is out of the predetermined range (Step S3, No), the hardware processor 51 calculates the rotation angle of the cam 21*d* from the deviation of the converted value from the predetermined range and drives the driver 21*e* to rotate the cam 21*d*. In this way, the hardware processor 51 increases the installation angle of the rigid blade 21*a* with respect to the intermediate transfer belt 17 and thus increases the effective contact angle accordingly so as to regulate the effective contact angle to the predetermined range (Step S4). Then, the processing ends.

Figure 8:
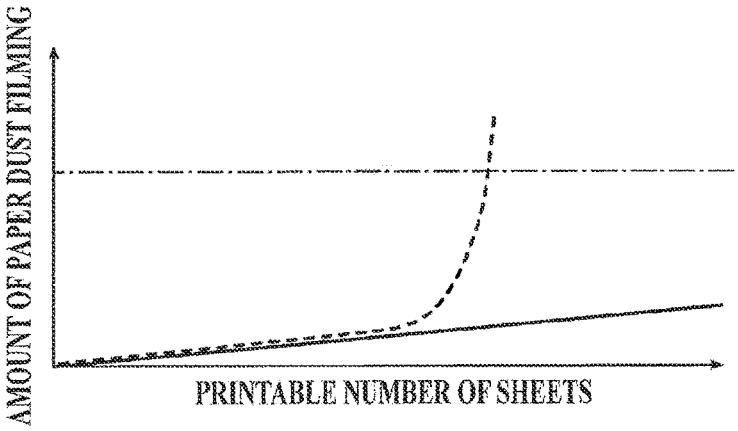
FIG. 8 illustrates the effect of the effective contact angle adjustment processing.

FIG. 8 is a graph illustrating the effect of the effective contact angle adjustment processing.

As illustrated in FIG. 8, when the effective contact angle adjustment processing is not performed (dashed line), paper dust filming is developed at an accelerated pace after a certain time. In contrast, when the effective contact angle adjustment processing is performed (solid line), the printable number of sheets of image formation can be improved.

The embodiment illustrates an example in which the strain is constantly measured. Instead, a determination as to whether it is a predetermined timing is made, and the strain is measured in the predetermined timing.

For example, the predetermined timing may be an arbitral timing such as when the number of images formed reaches a predetermined number (e.g. every 10 sheets, every 30 sheets and the like).

Figures 9, 10:
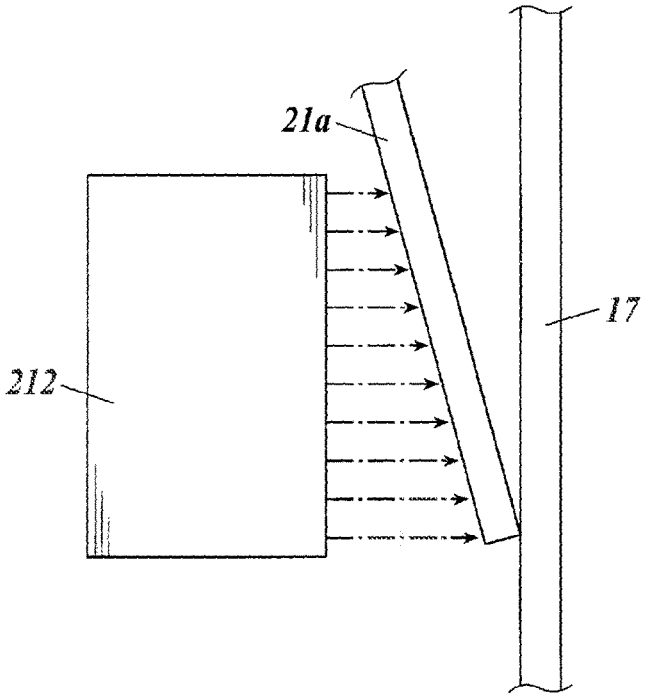
FIG. 9 illustrates the effect of the effective contact angle adjustment processing.
FIG. 10 illustrates a variation of the belt cleaning mechanism.

FIG. 9 is a table illustrating the difference of the printable number of sheets of image formation between a variety of timings of performing the effective contact angle adjustment processing.

As illustrated in FIG. 9, while it is better to perform the effective contact angle adjustment processing at shorter intervals, paper dust filming can be prevented for a comparatively long period (printable number of sheets: 500) when the processing is performed every 10 sheets of image formation.

FIG. 9 shows the results of evaluating the degree of paper dust filming based on the gross of the belt after passing through a predetermined number of sheets, which was conducted using a BIZHUB Pro C8000 in which a rigid blade with a plate thickness of 0.10 mm contacts the belt at a contact pressure of 20 N/m at an effective contact angle of 11°. The effective contact angle control was performed so that the effective contact angle is maintained at less than 13° (change of effective contact angle $\Delta\alpha<2°$).

The contact conditions of the blade and the optimal control range of the effective contact angle vary depending on the amount of toner to be cleaned, the belt hardness and the like. Although the details are not specified, good cleaning performance can be achieved for 10 g/m$^2$ or less of attached toner when the contact pressure ranges from 10 N/m to 30 N/m and the effective contact angle ranges from 8° to 20°. Further, when the change of effective contact angle is $\Delta\alpha\leq4°$, drastic development of paper dust filming can be prevented.

As described above, in the embodiment, the image forming apparatus 100, which forms an image by transferring a toner image formed on the intermediate transfer belt 17 with the elastic layer 17*b* in the surface to a sheet P, includes:

the metal rigid blade 21*a* which contacts with the intermediate transfer belt 17 from which the toner image has been transferred to the sheet P, so as to clean residues attached on the surface of the intermediate transfer belt 17;

the angle detector which detects the effective contact angle between the surface of the intermediate transfer belt 17 and the opposed surface of the rigid blade 21*a;* the angle changer which changes the effective contact angle; and the hardware processor 51 which controls the angle changer to regulate the effective contact angle to the predetermined range according to the detection result of the angle detector.

As described above, the position of the rigid blade 21*a* is detected, and the contact condition of the rigid blade 21*a* against the intermediate transfer belt 17 is adjusted. This can prevent edge separation and thereby reduce the occurrence of paper dust filming.

In the embodiment, the angle detector includes the measurement section which measures the degree of deflection of the rigid blade 21*a* and the calculator which converts the degree of deflection measured by the measurement section to the effective contact angle.

This allows detecting a change of the effective contact angle from the degree of deflection of the rigid blade 21*a*.

In the embodiment, the rigid blade 21*a* has an elongated shape that extends in the direction transverse to the moving direction of the intermediate transfer belt 17, and the measurement section measures the degree of deflection in the detection areas each with a predetermined length (2 mm or more) in the longitudinal direction of the rigid blade 21*a*.

This means that each measurement area is longer than the width in the longitudinal direction of an area in the rigid blade 21*a* that follows a local deformation. Therefore, the influence of such local deformation can be eliminated.

In the embodiment, the degree of deflection is measured in the multiple detection areas aligned in the longitudinal direction of the rigid blade 21*a*, and the detection area are arranged at predetermined spacing (10 mm to 100 mm).

This allows accurately detecting the distribution of the effective contact angle in the longitudinal direction of the rigid blade 21*a* without unnecessarily increasing the number of measurement areas.

In the embodiment, the measurement section measures the degree of deflection in the edge portion (the area with a length of 12 mm or less from the edge) of the rigid blade 21*a*.

This allows accurately measuring the effective contact angle.

In the embodiment, the measurement section is constituted by the strain gauges 211 that are attached on the rigid blade 21*a* and that generate a signal according to the deflection of the rigid blade 21*a*.

The usage of the strain gauges 211 allows measuring the effective contact angle with high precision (of 1° or less). Further, this can reduce the size of the apparatus, for example, compared to a technique of optically measuring the deflection of the blade.

In the embodiment, the strain gauges 211 are attached on the other surface of the rigid blade 21*a* from the opposed surface opposed to the intermediate transfer belt 17.

If the strain gauges 211 came off from the rigid blade 21*a* by any chance, this would be able to prevent the detached strain gauges 211 from contacting with the intermediate transfer belt 17 to damage it.

In the embodiment, the thickness of the strain gauges 211 is equal to or less than a half of the thickness of the rigid blade 21*a*.

This can prevent the attached strain gauges 211 from affecting the effective contact angle of the rigid blade 21*a*.

In the embodiment, the angle changer changes the installation angle of the rigid blade 21*a* with respect to the intermediate transfer belt 17.

In this way, the effective contact angle can be changed with such a simple configuration for changing the installation angle of the rigid blade 21*a*.

In the embodiment, the antivibration roller 26 is disposed in the upstream in the moving direction of the intermediate transfer belt 17 with respect to the rigid blade 21*a* to reduce the running vibration of the intermediate transfer belt 17.

This can reduce the vibration of the running intermediate transfer belt 17 and thereby allows accurately detecting the effective contact angle.

In the embodiment, the antivibration roller 26 is a driven roller that is in pressure contact with the intermediate transfer belt 17 in a fixed position.

This can efficiently reduce the vibration of the running intermediate transfer belt 17.

In the embodiment, the rigid blade 21*a* is rotatably held about the pivot G and the pivot angle of the rigid blade 21*a* with respect to the intermediate transfer belt 17 is configured to be narrower than the effective contact angle.

This can prevent an increase of the contact pressure due to draw-in of the edge of the rigid blade 21*a* and thereby prevent the intermediate transfer belt 17 from being shaved.

In the embodiment, the rigid blade 21*a* includes the coating layer of diamond-like carbon.

This can reduce abrasion of the edge of the rigid blade 21*a* with use and thereby reduce the occurrence of edge separation.

In the embodiment, the pre-brush 22 is provided in the upstream in the moving direction of the intermediate transfer belt 17 with respect to the rigid blade 21*a* to remove paper dust on the intermediate transfer belt 17.

This can facilitate reducing the occurrence of paper dust filming by removing paper dust that is to enter the rigid blade 21*a* of the intermediate transfer belt 17.

In the above-described embodiment, the strain gauges 211 are used to determine the effective contact angle of the rigid blade 21*a* by converting the measurement value. However, the measurement section is not limited thereto, and any means that can measure the effective contact angle can be used.

For example, as illustrated in FIG. 10, the measurement section may be constituted by an optical sensor 212 that measures the degree of deflection of the rigid blade 21*a* based on the amount of light.

For example, the optical sensor 212 is a line sensor or the like that includes an emitter that emits light and a receiver that receives reflection light and that measures a change in the amount of reflection. The hardware processor 51 converts the measurement value to the effective contact angle.

Also with this configuration, it is possible to measure the effective contact angle with an accuracy of 1° or less.

The above-described embodiment illustrates an example in which the cam 21*d* is used to change the effective contact angle of the rigid blade 21*a*. However, the present invention is not limited to this configuration and may have any configuration that can change the effective contact angle of the rigid blade 21*a*.

Figure 11:
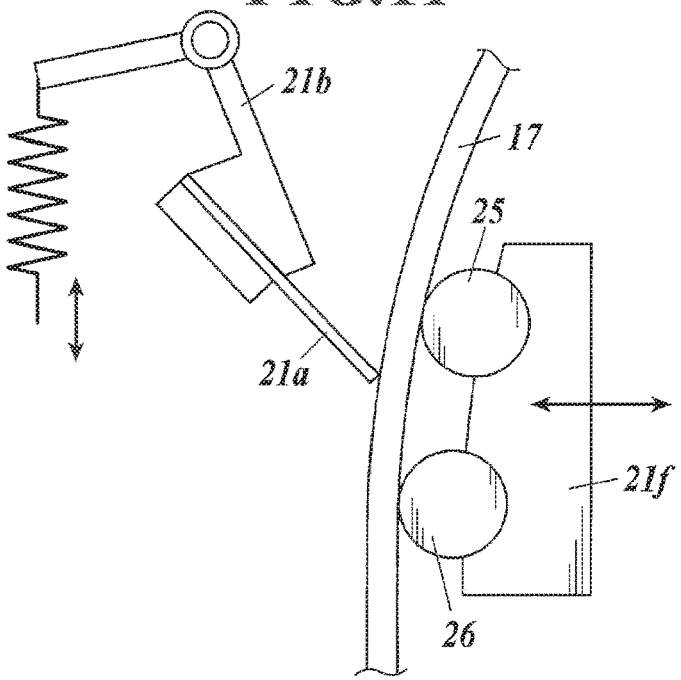
FIG. 11 illustrates a variation of the belt cleaning mechanism.
Figure 12:
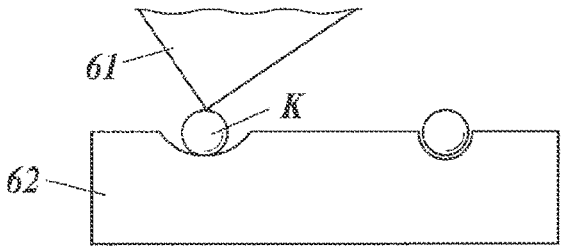
FIG.12 PRIOR ART
FIG. 12 illustrates a problem with the prior art.
Figure 13:
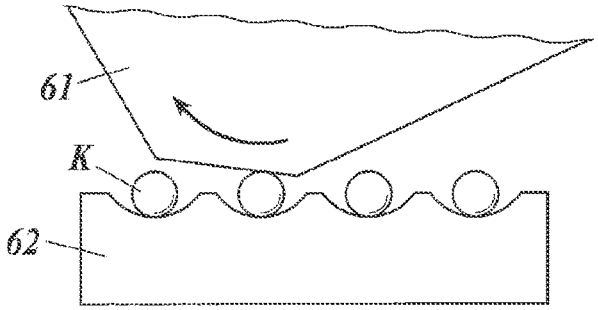
FIG.13 PRIOR ART
FIG. 13 illustrates a problem with the prior art.

For example, as illustrated in FIG. 11, a unit 21*f* including the blade counter roller 25 and the antivibration roller 26 may be provided instead of the cam 21*d*, and the unit 21*f* is moved in the direction away from the intermediate transfer belt 17 to reduce the contact pressure of the rigid blade 21*a* so as to change the effective contact angle of the rigid blade 21*a*.

The above-described embodiment illustrates an example in which the surface of the intermediate transfer belt 17 is cleaned. However, the present invention is not limited thereto and is also applicable to image forming apparatuses for cleaning the surface of different image carrier belts other than an intermediate transfer belt.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2017-007232, filed on Jan. 19, 2017, is incorporated herein by reference in its entirety.

What is claimed is:

1. An image forming apparatus that forms an image by transferring a toner image to a sheet, the toner image being formed on an image carrier belt with an elastic layer on a surface, the apparatus comprising:

a rigid blade which contacts with the image carrier from which the toner image has been transferred to the sheet, so as to clean residue attached on the surface of the image carrier;

an angle detector which detects an effective contact angle between the surface of the image carrier and an opposed surface of the rigid blade opposed to the image carrier;

an angle changer which changes the effective contact angle; and a hardware processor which controls the angle changer according to a detection result by the angle detector to regulate the effective contact angle to a predetermined range, wherein the angle detector comprises a measurement section which measures a degree of deflection of the rigid blade and a calculator which converts the degree of deflection measured by the measurement section to the effective contact angle, the measurement section includes a strain gauge attached to the rigid blade and which generates a signal according to the degree of deflection of the rigid blade, and a thickness of the strain gauge is equal to or less than a half of the thickness of the rigid blade.

2. The image forming apparatus according to claim 1, wherein the rigid blade is constituted by a metal blade.

3. The image forming apparatus according to claim 1, wherein the rigid blade has an elongated shape which extends in a direction transverse to a moving direction of the image carrier, and wherein the measurement section measures the degree of deflection in a detection area with a predetermined length in a longitudinal direction of the rigid blade.

4. The image forming apparatus according to claim 3, wherein the measurement section measures the degree of deflection in detection areas arrayed in the longitudinal direction of the rigid blade, and wherein the detection areas are disposed at a predetermined spacing.

5. The image forming apparatus according to claim 1, wherein the measurement section measures the degree of deflection in an edge portion of the rigid blade.

6. The image forming apparatus according to claim 1, wherein the strain gauge is attached on an other surface of the rigid blade from an opposed surface opposed to the image carrier.

7. The image forming apparatus according to claim 1, wherein the angle changer changes an installation angle of the rigid blade with respect to the image carrier.

8. The image forming apparatus according to claim 1, wherein the angle changer changes a contact pressure of the rigid blade against the image carrier.

9. The image forming apparatus according to claim 1, wherein the image carrier is an intermediate transfer belt.

10. The image forming apparatus according to claim 1, further comprising: an antivibration roller which is disposed in an upstream in a moving direction of the image carrier with respect to the rigid blade to reduce running vibration of the image carrier.

11. The image forming apparatus according to claim 10, wherein the antivibration roller is a driven roller which is in pressure contact with the image carrier in a fixed position.

12. The image forming apparatus according to claim 1, wherein the rigid blade is rotatably supported about a pivot, and wherein a pivot angle of the rigid blade with respect to the image carrier is narrower than the effective contact angle, wherein the pivot angle is an angle between the surface of the intermediate transfer belt and a line connecting the pivot to a contact point between the rigid blade and the intermediate transfer belt.

13. The image forming apparatus according to claim 1, wherein the rigid blade comprises a coating layer of diamond-like carbon.

14. The image forming apparatus according to claim 1, further comprising: a rotary body which is disposed upstream in a moving direction of the image carrier with respect to the rigid blade to remove paper dust on the image carrier.

* * * * *